US006453510B1

(12) United States Patent
Cummins et al.

(10) Patent No.: US 6,453,510 B1
(45) Date of Patent: Sep. 24, 2002

(54) SINGLE LINK DUAL-CONTACT POINT HINGE ASSEMBLY

(75) Inventors: Steven O. Cummins, Mansfield; Jeffrey D. Habegger, Wadsworth, both of OH (US)

(73) Assignee: Mansfield Assemblies Co., Mansfield, OH (US)

( * ) Notice: Subject to any disclaimer, the term of this patent is extended or adjusted under 35 U.S.C. 154(b) by 1 days.

(21) Appl. No.: 09/666,713

(22) Filed: Sep. 21, 2000

(51) Int. Cl.[7] ..... E05D 11/10; E05F 1/08

(52) U.S. Cl. ..... 16/343; 16/374; 16/297; 16/289; 49/386; 126/194

(58) Field of Search ..... 16/343, 321, 362, 16/344, 374, 297, 306, 331, 332, 289; 49/386, 387; 126/194, 192, 190

(56) References Cited

U.S. PATENT DOCUMENTS

| | | | | | |
|---|---|---|---|---|---|
| 3,150,658 | A | | 9/1964 | Ferland | |
| 3,327,701 | A | | 6/1967 | Smith | |
| 3,450,125 | A | | 6/1969 | Hopkins | |
| 3,749,080 | A | * | 7/1973 | Kleinhenn | 16/289 |
| 3,838,538 | A | * | 10/1974 | Burford | 126/194 |
| 3,889,654 | A | | 6/1975 | Kauranen et al. | |
| 3,955,865 | A | * | 5/1976 | Wilson | 126/191 |
| 4,001,973 | A | * | 1/1977 | Rice et al. | 49/386 |
| 4,096,602 | A | | 6/1978 | Nelson | |
| 4,103,671 | A | | 8/1978 | Smith | |
| 4,287,873 | A | * | 9/1981 | Goins et al. | 16/289 |
| 4,665,892 | A | * | 5/1987 | Spargo et al. | 16/289 |
| 5,025,776 | A | | 6/1991 | Hanley et al. | |
| 5,291,634 | A | * | 3/1994 | Zanetti | 16/333 |
| 5,822,925 | A | | 10/1998 | McKinney et al. | |
| 5,881,710 | A | | 3/1999 | Davis et al. | |
| 6,035,848 | A | | 3/2000 | Ray et al. | |

* cited by examiner

*Primary Examiner*—Chuck Y. Mah
(74) *Attorney, Agent, or Firm*—Fay, Sharpe, Fagan, Minnich & McKee, LLP

(57) ABSTRACT

A hinge assembly includes a claw and a channel pivotably connected to the claw at a first pivot point so that the channel is adapted for movement on an arc in a first direction from a first operative position to a second operative position. The channel is also adapted for movement on the arc in a second direction opposite the first direction. First and second link stops are connected to the channel, and a link assembly is operably interconnected between the claw and the channel. The link assembly, itself, includes: (i) a link member defining first and second opposite contact surfaces and first and second opposite ends, wherein the first end is pivotably connected to the claw; and, (ii) a coil spring having a first end connected to the second end of said link member and a second end connected to the channel adjacent a second end of the channel. The link member is movably positioned relative to the first and second link stops and moves toward the first end of said channel when the channel is moved in the first direction from the first operative position to the second operative position. The first and second contact surfaces of the link member engage the first and second link stops, respectively, when the channel is in the second operative position, and this prevents movement of the channel in the first direction beyond the second operative position.

10 Claims, 6 Drawing Sheets

SINGLE LINK DUAL-CONTACT POINT HINGE ASSEMBLY

BACKGROUND OF THE INVENTION

The present invention relates to a novel and non-obvious hinge assembly of simplified construction relative to corresponding conventional hinge assemblies. The invention is described herein in relation to an appliance (e.g. oven) door hinge assembly, but those of ordinary skill in the art will recognize that a hinge assembly formed in accordance with the present invention has wider application. It is not intended that the claims be construed as limiting the invention for use in association with any particular type of appliance or any other application.

Dual-link hinge assemblies of the type illustrated in FIGS. 1–4 are, widely known. The hinge assembly A includes a claw B adapted for connection to an appliance frame or chassis, and a first end of a channel C is pivotally connected to the claw B at a pivot point D so that the channel is adapted for movement on an arc E relative to the claw. Typically, the channel C is connected to an appliance door such as an oven door.

The claw B and the channel C are also operably interconnected through a link assembly F. The link assembly F comprises first and second parallel, identical link members G1, G2 (FIGS. 2 and 4) that are pivotally connected at their first ends to the claw B. The link members are connected at an opposite, second end to the first end of a coil spring H (shown partially in phantom lines, for clarity) by way of a transversely extending rivet or other fastener L. The opposite, second end of the coil spring H is secured to a second end of the channel C or a member connected thereto.

A roller I spans the channel C adjacent the link members G1, G2, and the link members each define a contact surface J that moveably engages the roller I. The links also each define a catch or dwell point K that is adapted to receive and retain the roller I when the channel C is pivoted a maximum distance away from the claw B on the arc E (FIG. 3). That is, when the roller I is seated in the dwell point K, further movement of the channel C on the arc E. in the first direction E1 is prevented. The contact surface J of each link member G1, G2 also defines a lobe M adjacent the link first end that is conformed to engage the roller I when the channel is in its first operative position and urge the channel member C rearwardly (to the right in FIG. 1) away from the links G1, G2 so that the channel member is securely held in its first operative position.

In operation, the channel and a door or other structure connected thereto is pivotally moveable on the arc E to and between two operative positions: (1) a first operative position (FIGS. 1, 2, 4) wherein the coil spring H is relatively relaxed and wherein the roller I is spaced from the dwell point K; and, (2) a second operative position (FIG. 3) wherein the channel C is pivoted a maximum distance away from the claw B in the first direction E1 so that the coil spring H is tensioned and elongated and so that the link members G1, G2 are moved toward the channel first end until the roller I is seated in the dwell point K of both links G1, G2. As noted, the engagement of the roller I in the link dwell points K prevents further pivoting movement of the channel C beyond the second operative position and, thus, significant loads are exerted on the links G1, G2 when forces are applied to the channel C in an effort to move the channel beyond the second operative position in the first direction. The use of two links G1, G2 has heretofore been required because a single link has been found to deform and elongate over time or if excessive force is applied to the channel C in an effort to pivot the channel beyond the second operative position as described. Notably, the links G1, G2 are not supported by any fixed support member other than the roller, i.e., the links are each supported at only a single contact point. Furthermore, the rivet L adds manufacturing complexity and expense to the hinge assembly A.

While hinges of the type illustrated in FIGS. 1–4 have enjoyed widespread commercial success, the use of two link members G1, G2 adds cost and complexity to the hinge assembly. It has been deemed desirable to develop a simpler, more cost-effective hinge assembly of the general type described above, that overcomes the above-noted and other deficiencies while providing better overall performance and durability.

SUMMARY OF THE INVENTION

In accordance with the present invention, a new and improved single link, dual-contact point hinge assembly is disclosed.

In accordance with a first aspect of the invention, a hinge assembly comprises a claw and a channel pivotably connected to the claw at a first pivot point so that the channel is adapted for movement on an arc in a first direction from a first operative position to a second operative position. The channel is also adapted for movement on the arc in a second direction opposite the first direction. First and second link stops are connected to the channel, and a link assembly is operably interconnected between the claw and the channel. The link assembly, itself, comprises: (i) a link member defining first and second opposite contact surfaces and first and second opposite ends, wherein the first end is pivotably connected to the claw; and, (ii) a coil spring having a first end connected to the second end of said link member and a second end connected to the channel adjacent a second end of the channel. The link member is movably positioned relative to the first and second link stops and moves toward the first end of said channel when the channel is moved in the first direction from the first operative position to the second operative position. The first and second contact surfaces of the link member engage the first and second link stops, respectively, when the channel is in-the second operative position, and this prevents movement of the channel in the first direction beyond the second operative position.

In accordance with another aspect of the present invention, a hinge assembly comprises a first member adapted for connection to a frame of an associated oven, and a second member adapted for connection to a door of the associated oven. The second member is pivotably connected at a first end thereof to the first member and is adapted for pivoting movement on an arc relative to the first member between a first operative position that corresponds to a closed position of the associated door, and a second position that corresponds to an open position of the associated door. A spring is connected to the second member at a point spaced away from the first end of the second member. A link member includes a first end pivotably connected to the first member and a second end connected to the spring. The link member defines first and second oppositely facing contact surfaces. First and second link stops are connected to the second member at first and second spaced locations, with the link member intermediate the first and second link stops with the first contact surface adjacent the first link stop and the second contact surface adjacent the second link stop when the second member is in its second operative position. The first and second link stops engage the first and second contact surfaces, respectively, when the second member is moved to the second operative position and prevent movement of the second member beyond the second operative position away from the first operative position.

One advantage of the present invention resides in the provision of a single link, dual-contact point hinge assembly.

Another advantage of the present invention resides in the provision of a hinge assembly that is cost-effective and simple to manufacture due to use of fewer components, smaller components, and due to ease of manufacturing.

Still another advantage of the present invention resides in the provision of a single link, dual-contact point hinge assembly wherein a hooked end of a main spring of the hinge assembly is connected to a single link member by passage of the hooked end through an aperture defined in the link member which eliminates a rivet, minimizes hinge thickness, and helps to control the spring in the event it breaks in that it is captured-in the aperture.

A further advantage of the present invention is found in the provision of a hinge assembly that uses only a single link, and wherein the link, when in its second operative position, resists deformation forces owing to the fact that the link is supported by at least two fixed support members.

Another advantage of the present invention is found in the provision of a hinge assembly that uses only a single link, wherein the link is simultaneously supported on first and second opposed contact surfaces thereof by at least first and second fixed support members.

A further advantage of the present invention results from the provision of a hinge assembly including a single link member, wherein the link member moves in a direction toward a first end of the channel when the channel is pivoted from its first position to the second position, and wherein the link, when the channel is in its second operative position, is wedged between first and second fixed support members that prevent further movement of the link toward the channel first end.

A further advantage of the present invention resides in the provision of a single link, dual-contact point hinge assembly that requires less rivets, shorter rivets, and less grease than conventional hinge assemblies.

Still another advantage of the present invention is found in the provision of a single link, dual-contact point hinge assembly that is quieter than conventional hinge assemblies owing to the use of fewer components that move relative to each other.

Still other benefits and advantages of the invention will become apparent to those of ordinary skill in the art to which the invention pertains upon reading the following specification.

BRIEF DESCRIPTION OF THE DRAWINGS

The invention comprises a variety of components and arrangements of components, preferred embodiments of which are illustrated in the accompanying drawings that form a part hereof and wherein.

DETAILED DESCRIPTION OF THE PREFERRED EMBODIMENT

Referring now to FIGS. 5–8, wherein the showings are for purposes of illustrating a preferred embodiment of the invention only and not for purposes of limiting the invention, a hinge assembly 10 formed in accordance with the present invention includes an elongated channel member 12 preferably defined from a U-shaped member that defines a longitudinally extending recess 14 in a front face. The channel member extends axially between first and second opposite ends 16, 18.

Figure 1:
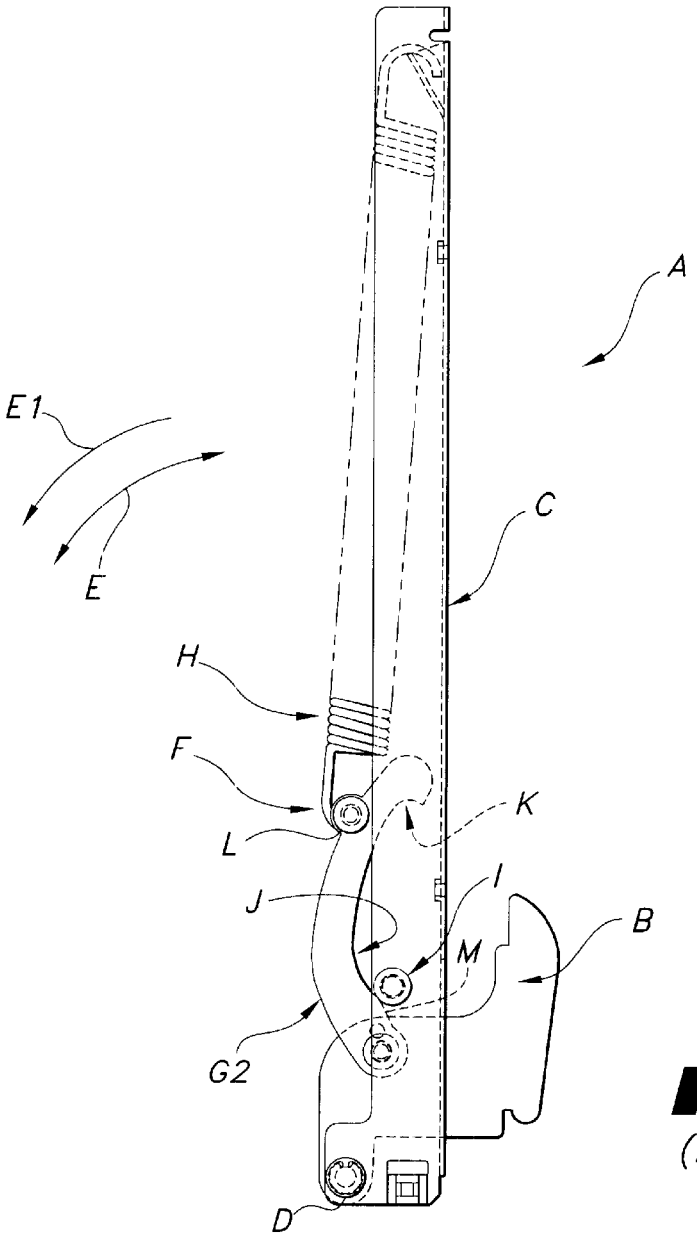
FIG. 1 (PRIOR ART)
FIG. 1 is a side elevational view of a prior art hinge assembly in a first operative position.
Figure 2:
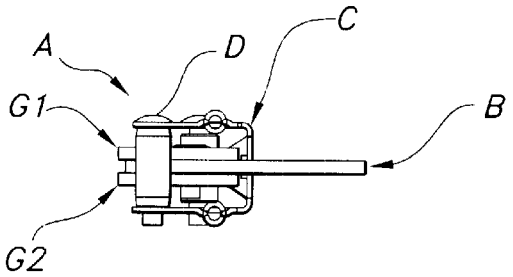
FIG. 2 (PRIOR ART)
FIG. 2 is a bottom view of the prior art hinge assembly shown in FIG. 1.
Figure 3:
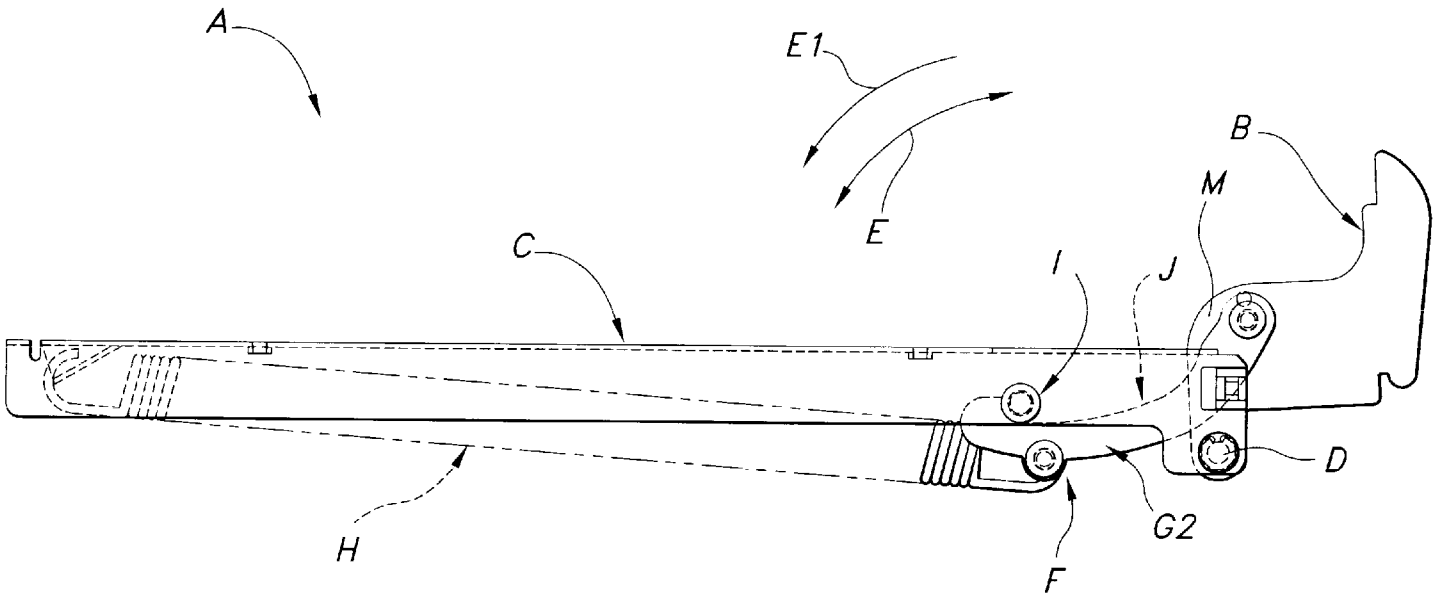
FIG 3 (PRIOR ART)
FIG. 3 is a side elevational view of the hinge assembly shown in FIG. 1 in a second operative position.
Figure 4:
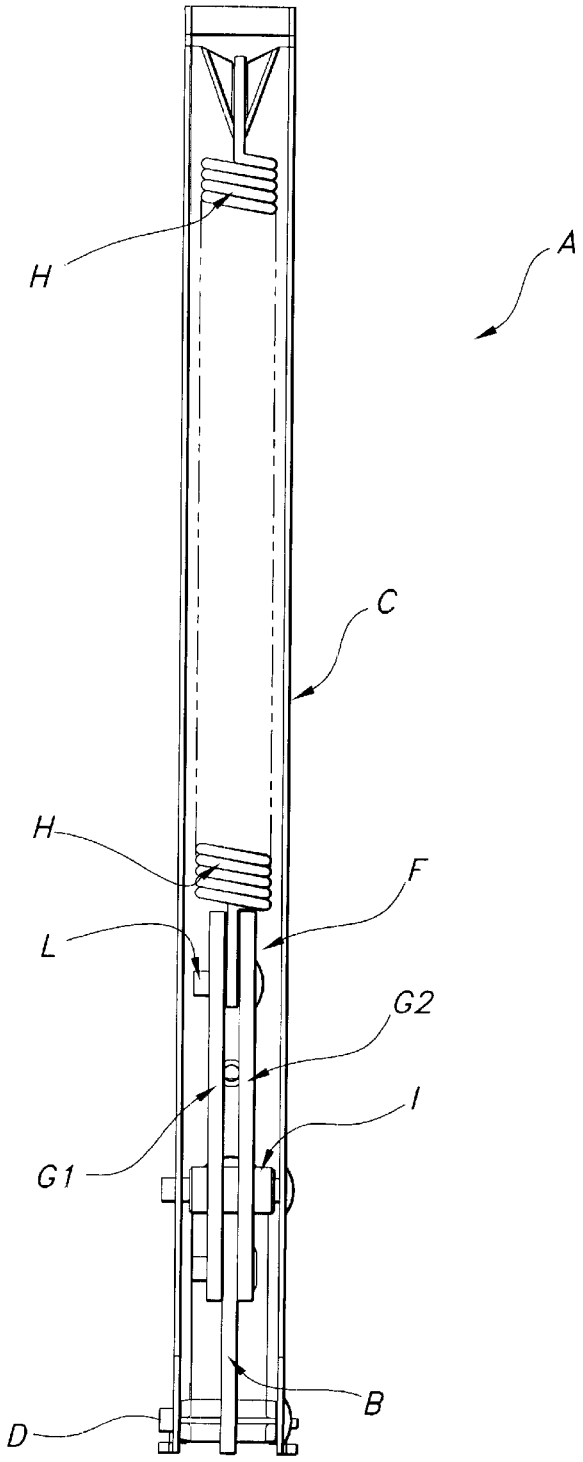
FIG. 4 (PRIOR ART)
FIG. 4 is a front elevational view of the hinge assembly shown in FIG. 1.
Figure 5:
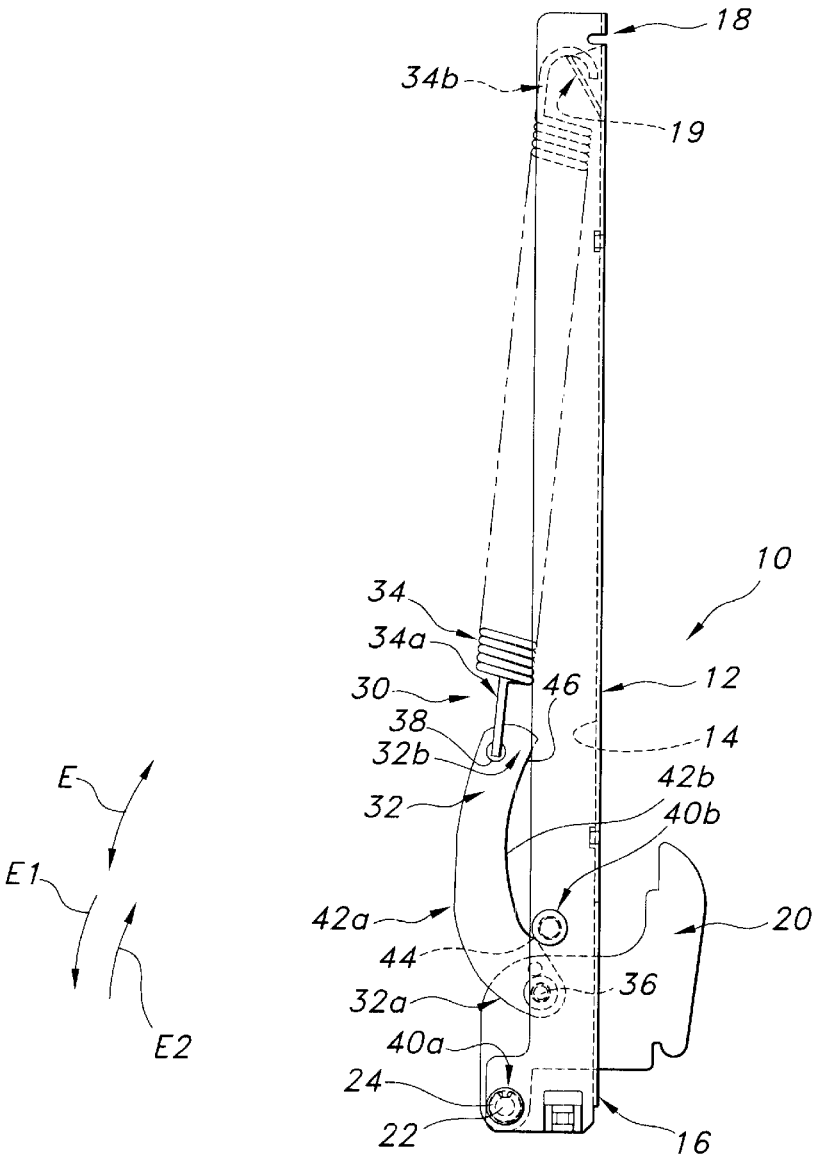
FIG. 5 is a side elevational view of a hinge assembly formed in accordance with the present invention in a first operative position.
Figure 6:
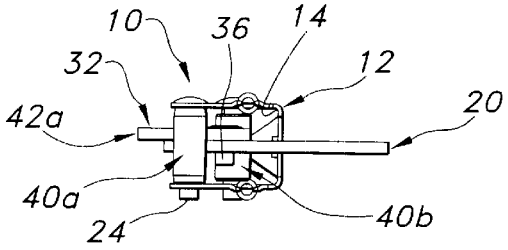
FIG. 6 is a bottom view of the hinge assembly shown in FIG. 5.
Figure 7:
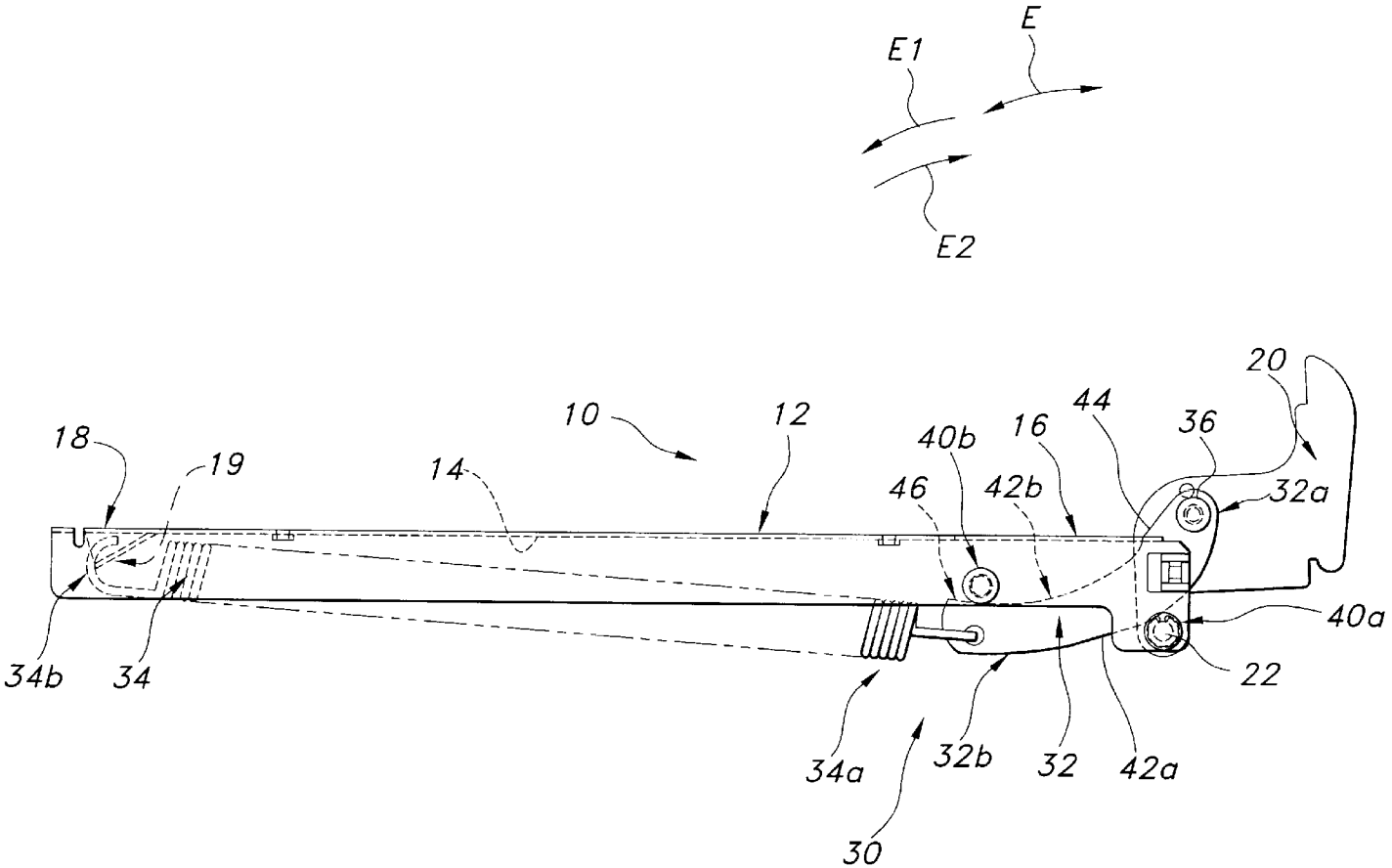
FIG. 7 is a side view of the hinge assembly shown in FIG. 5 in a second operative position.
Figure 8:
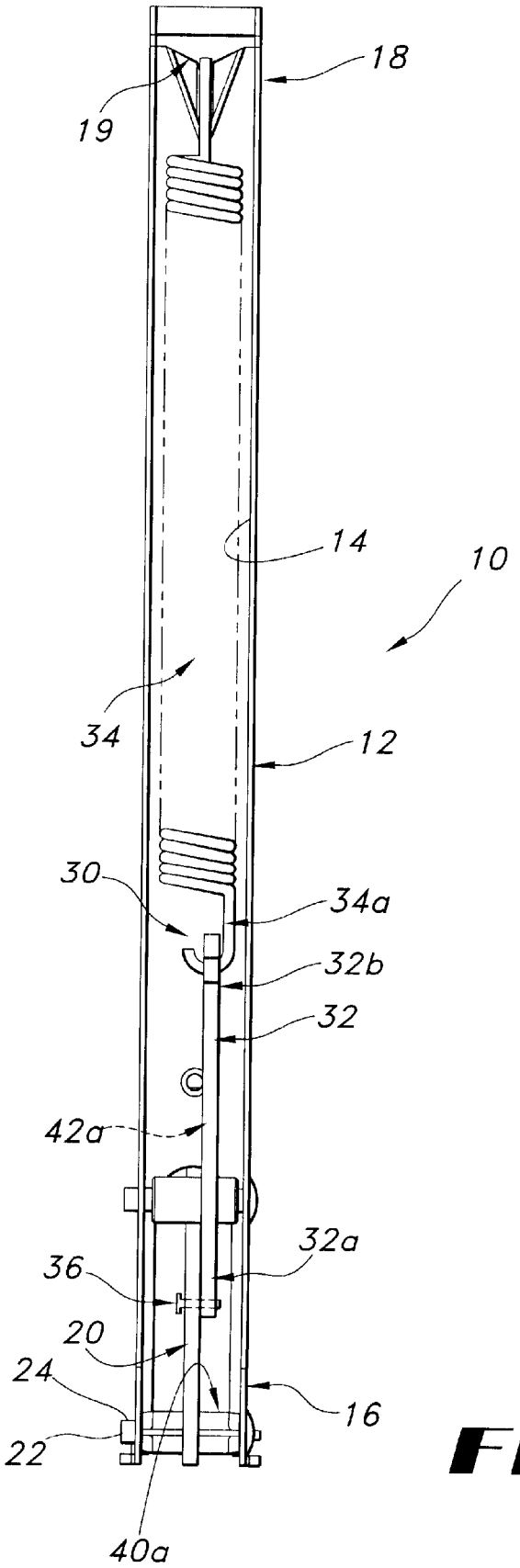
FIG. 8 is a front elevational view of the hinge assembly shown in FIG. 5.

A claw member 20 is pivotably connected to the channel 12 adjacent the first end 16 at a pivot point 22 by way of a transverse rivet or other fastener 24. Thus, the channel 12 is adapted for pivoting movement relative to the claw 20 about the pivot point 22 on an arc E in respective first and second opposite directions E1, E2. The channel is movable on the arc E to and between a first operative position (FIGS. 5, 6, 8) and a second operative position (FIG. 7). As is generally known in the art, the claw 20 is adapted for connection to an appliance frame or chassis, such as that of an oven or the like, and the channel is adapted for connection to an appliance door, such as an oven door. Thus, the hinge assembly 10 (typically provided in a pair) is adapted for supporting an appliance door relative to the appliance frame so that the door is pivotably movable between a closed position that corresponds to the first operative position of the channel 12, and an open position that corresponds to the second operative position of the channel 12. The transverse rivet 24, or a sleeve, bushing, or other member held thereby, preferably provides a first link stop 40*a*, the purpose of which is described in full detail below.

In addition to being interconnected at the pivot point 22, the claw and channel 12 are operably interconnected by a link assembly 30 comprising a single link member 32 and a spring 34. A first end 32*a* of the link member 32 is pivotably connected to a central region of the claw 20 by a rivet 36 (FIGS. 5, 7), and a second end 32*b* of the link member 32 is connected to a first end 34*a* of the spring 34. The second end 34*b* of the spring is fixedly secured to the channel member 12, preferably adjacent the channel member second end 18 or at least at a point axially spaced from the first end 16 of the channel member 12. As shown herein, it is most preferred that, in order to minimize the use of fasteners such as rivets, the spring 34 be a coil spring conformed with hooks at both its first and second ends 34*a*, 34*b*—the hook at the spring first end 34*a* adapted to engage an aperture 38 or other portion of the link member 32, and the hook at the spring second end 34*b* adapted to engage a projecting portion 19 of the channel second end 18. The link member 32 also defines opposite first and second contact surfaces or edges 42*a*, 42*b*, respectively.

In addition to the first transverse link stop 40*a* noted above, the hinge assembly 10 further comprises second transverse link stop 40*b*, preferably provided in the form of a stud or roller, connected to the channel member 12 adjacent the second contact surface 42*b* of the link member. The link member 32 is located between the first and second link stops 40*a*, 40*b*, with the first contact surface 42*a* adjacent the first link stop 40*a*, and the second contact surface 42*b* adjacent the second link stop 40*b* when the channel is in the second operative position as shown in FIG.

7. A first end of the second surface 42*b* defines a projecting lobe 44 that is conformed to engage She second link stop 40*b* when the channel is in its first operative position. The lobe 44 urges the second link stop 40*b* and, thus, the channel member 12, away from the link member 32 to hold the channel member in its first operative position. The second end 46 of the second contact surface 42*b* is conformed to curve smoothly toward the channel member 12. Notably, no dwell point need be defined in the second end 46 of the surface 42*b*. This allows the link member 32 to be smaller in size.

The spring 34 is preferably a coil spring that normally biases the channel 12 into its first operative position. When the channel is in its first operative position, the spring 34 is preferably at least relatively relaxed. Upon movement of the channel 12 in the first direction E1 on the arc E toward the second operative position, the spring 34 elongates and is tensioned. As the spring elongates, the link 32 moves toward the first end 16 of the channel 12, with the second link stop 40*b* preferably continuously engaging the second contact surface 42*b* of the link 32. With particular reference to FIG. 7, when the channel 12 is moved fully into its second operative position, the second link stop 40*b* is engaged with the second end 46 of the second contact surface 42*b* which causes the link 32 to be urged away from the channel 12, i.e., outwardly of the channel recess 14. This, then, causes the first contact surface 42*a* of the link 32 to engage and be held in engagement with the first transverse link stop member 40*a* connected to the channel 12. As noted above, in the most preferred embodiment illustrated herein, the first link stop member 40*a* is provided by the rivet 24 that pivotably interconnects the claw 20 and the channel 12, or is provided by a bushing, sleeve, or other member affixed to the channel by the rivet 24.

With reference again to FIG. 7, those of ordinary skill in the art will recognize that, owing to the fact that the first and second contact surfaces 42*a*, 42*b* of the link member 32 are in respective contact with first and second link stops 40*a*, 40*b* when the channel member 12 is in its second operative position, the channel member 12 is unable to pivot farther in the first direction E1, i.e., engagement of the first and second link contact surfaces 42*a*, 42*b* with the first and second link stops 40*a*, 40*b*, respectively, provides a stop that defines the second operative position of the channel member 12.

When the channel is in its second operative position; as shown in FIG. 7, the link 32 is wedged into engagement; with the first and second link stops 40*a*, 40*b* and is also held in position by the fastener 36 that connects the link 32 to the claw 20. With the link 32 so positioned, application of force on the channel member 12 in an effort to move it further in the first direction E1 causes the force to be distributed in a triangular pattern between the first and second link stops 40*a*, 40*b*, and the connection point 36 between the link member 32 and the claw 20. Furthermore, when the channel is in its second operative position, the link 32 is engaged with and supported by both the first and second link stops 40*a*, 40*b*, as well as the rivet 36.

The invention has been described with reference to preferred embodiments. Of course, modifications and alterations will occur to others upon a reading and understanding of the preceding specification. It is intended that the invention be construed as including all such modifications and alterations.

Having thus described the preferred embodiments, what is claimed is:

1. A hinge assembly comprising:

a claw;

a channel having a first end and a second end, said first end of said channel pivotably connected to the claw at a first pivot point whereby said channel is adapted for movement on an arc in a first direction from a first operative position to, a second operative position, and in a second direction opposite said first direction;

first and second link stops connected to said channel;

a link assembly operably interconnected between said claw and said channel, said link assembly comprising:

(i) a link member defining first and second opposite contact surfaces and first and second opposite ends, said first end pivotably connected to said claw; and, (ii) a coil spring having a first end connected to said second end of said link member and a second end connected to said channel adjacent said second end of said channel:

said link member movably positioned relative to said first and second link stops and movable toward said first end of said channel in response to movement of said channel in said first direction from said first operative position to said second operative position, said first and second contact surfaces of said link member engageable with said first and second link stops, respectively, when said channel is in said second operative position and preventing movement of said channel in said first direction beyond said second operative position.

2. The hinge assembly as set forth in claim 1, wherein said first end of said link member is pivotably connected to said claw at a second pivot point, and wherein said first pivot point, said second pivot point, and said second link stop define a triangle when said channel is located in its second operative position.

3. The hinge assembly as set forth in claim 2, wherein said first link stop is connected to said channel at said first pivot point.

4. The hinge assembly as set forth in claim 3, wherein said first link stop comprises a fastener that pivotably interconnects said channel to said claw.

5. The hinge assembly as set forth in claim 4, wherein said fastener comprises a rivet, and wherein said rivet supports said link stop in a recess defined by said channel.

6. The hinge assembly as set forth in claim 1, wherein said second contact surface defines a lobe adjacent said first end of said link, said lobe conformed so that, when said channel is in said first operative position, said lobe engages said second link stop and holds said channel in said first operative position.

7. The hinge assembly as set forth in claim 1, wherein said second end of said link member defines an aperture, and wherein said first end of said coil spring defines a hook that is inserted through said aperture.

8. The hinge assembly as set forth in claim 1, wherein said claw is connected to said link member adjacent said first end of said link member, and wherein, when said channel is in said second operative position, said second link stop engages said second contact surface adjacent said second end of said link member and said first link stop engages said first contact surface at a point on said first contact surface between said first and second ends of said link member.

9. The hinge assembly as set forth in claim 8, wherein said link member is located between said first and second link stops, with said first contact surface adjacent said first link stop and said second contact surface adjacent said second link stop, when said channel is in said second operative position.

10. A hinge assembly comprising:

a first member adapted for connection to a frame of an associated oven;

a second member adapted for connection to a door of the associated oven, said second member pivotably connected at a first end thereof to said first member and adapted for pivoting movement on an arc relative to said first member between a first operative position that corresponds to a closed position of said associated door, and a second position that corresponds to an open position of said associated door;

a spring connected to said second member at a point spaced away from said first end of said second member;

a link member that includes a first end pivotably connected to said first member and a second end connected to said spring, said link member defining first and second oppositely facing contact surfaces; and, first and second link stops connected to said second member at first and second spaced locations, said link member intermediate said first and second link stops with said first contact surface adjacent said first link stop and said second contact surface adjacent said second link stop when said second member is in its second operative position, said first and second link stops engageable with said first and second contact surfaces, respectively, and preventing movement of said second member beyond said second operative position away from said first operative position when said second member is moved to said second operative position.

* * * * *